US006981298B2

(12) United States Patent
Isoda et al.

(10) Patent No.: US 6,981,298 B2
(45) Date of Patent: Jan. 3, 2006

(54) CLIP STRUCTURE AND CLIP STRUCTURE ASSEMBLING METHOD

(75) Inventors: Takashi Isoda, Yokohama (JP); Chiharu Kai, Kawasaki (JP); Tomoaki Suzuki, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 19 days.

(21) Appl. No.: 10/702,600

(22) Filed: Nov. 7, 2003

(65) Prior Publication Data

US 2004/0096262 A1 May 20, 2004

(51) Int. Cl.
*A45F 5/00* (2006.01)
*A44B 21/00* (2006.01)
*B43K 25/00* (2006.01)

(52) U.S. Cl. ..... 24/3.12; 24/3.11; 24/10 R; 224/197; 401/104; 401/131

(58) Field of Classification Search ..... 24/3.11, 24/3.12, 3.9, 3.7, 10 R, 11 R; 224/197; 401/104
See application file for complete search history.

(56) References Cited

U.S. PATENT DOCUMENTS

| | | | | |
|---|---|---|---|---|
| 4,100,653 | A * | 7/1978 | Sensabaugh | 24/3.11 |
| 5,806,146 | A * | 9/1998 | Chen | 24/3.11 |
| 5,988,577 | A * | 11/1999 | Phillips et al. | 224/197 |
| 6,443,340 | B1 * | 9/2002 | Chung et al. | 224/197 |
| 6,685,067 | B2 * | 2/2004 | French | 224/198 |
| 6,752,299 | B2 * | 6/2004 | Shetler et al. | 224/197 |
| 2003/0085244 | A1 * | 5/2003 | Parsons | 224/197 |

* cited by examiner

*Primary Examiner*—Robert J. Sandy
(74) *Attorney, Agent, or Firm*—McGinn IP Law Group, PLLC

(57) ABSTRACT

There is provided a clip structure that can be used with a clip rotated and a clip structure assembling method. The clip structure includes, a clip body that is formed into a substantial U shape to form a holding portion in which a thin object to be clipped is held, a clip securing member for securing the clip body so that a side of an opening of the clip body can rotate along an arc and stop, and an elastic body that urges the clip body along a rotation axis of the clip body toward the clip securing member is provided to urge the clip body toward the clip securing member.

11 Claims, 8 Drawing Sheets

CLIP STRUCTURE AND CLIP STRUCTURE ASSEMBLING METHOD

BACKGROUND OF THE INVENTION

1. Field of the Invention

The present invention relates to a clip, for example, used in a writing instrument, and an assembling method of the clip.

2. Description of the Related Art

Various types of techniques are known relating to a clip provided on a writing instrument. For example, "CLIP MOUNTING STRUCTURE" disclosed in Japanese Utility Model Laid-Open No. 56-5684 has a feature that a position of a clip on a fountain pen can be changed between a non-writing capped state and a writing state.

There has been a need for changing a direction of a clip in a non-writing state, particularly for rotating the clip to form an angle of 90° or the like between an axial direction of a writing instrument and the clip for use.

Not restricting to the clip on the writing instrument, such a need also arises in a clip of a small article that holds a thing with the clip or is secured somewhere by clipping.

SUMMARY OF THE INVENTION

Therefore, an object of the invention is to provide a clip structure that can be used with a clip rotated and a clip structure assembling method.

The invention provides means for solving the above described problem.

According to a first aspect of the invention, a clip structure includes a clip body formed into a substantial U shape to form a holding portion in which a thin object to be clipped is held and an opening on one side, and a clip securing member that is integral with an object to which a clip is secured, and secures the clip body so that a side of an opening of the clip body can rotate along an arc track and stop rotating, wherein an elastic body that urges the clip body along a rotation axis of the clip body toward the clip securing member is provided to urge the clip body toward the clip securing member.

The object to be clipped is an object to which an article having the clip structure according to the invention is secured. Specifically, the object to be clipped includes a breast pocket, a sheet member (such as a note, a clear folder, or a front cover of a notebook).

The clip structure according to the invention is provided on a small article that fits in abreast pocket, and functions. The small article is the object to which a clip is secured, and specifically includes an article clipped to an edge of a breast pocket, typically, a writing instrument (more specifically, a ball point pen, a mechanical pencil, a fountain pen, a cap of a fountain pen), a mobile phone, a name tag, or the like).

The elastic body includes a coil spring, a leaf spring, an elastic sheet such as a rubber sheet, or the like. The leaf spring is the most preferable, because it can provide sufficient repulsion even in a small space. When the coil spring is used, a tensile spring can be used as well as a compression spring.

The term "being integral" used herein refers to both cases where the clip securing member is separately formed from the object to which a clip is secured, and the clip securing member can be secured to the object to which a clip is secured, and where the clip securing member is originally formed integrally with the object to which a clip is secured.

Because the clip body is urged toward the clip securing member, the clip body and the clip securing member abut against each other to secure the clip body so that the side of the opening of the clip body can rotate along an arc track and stop rotating. Therefore, the clip body can be rotated with respect to the clip securing member so that the side of the opening rotates along an arc track. If the clip body is rotated and then stopped, the opening can be moved to a suitable position and inserted the object to be clipped.

The clip securing member can be integrally moulded with the object to which a clip is secured.

For example, in the clip structure, the clip securing member may be integrally formed with the object to which a clip is secured to be secured to the object to be clipped via the clip body.

Because the clip securing member is integrally formed with the object to which a clip is secured, if the clip body is secured to the object to be clipped, the object to which a clip is secured is secured to the object to be clipped.

Alternatively, the clip securing member can be separately formed from the object to which a clip is secured.

For example, in the clip structure, the clip securing member may be separately formed from the object to which a clip is secured to be secured to the object to be clipped via the clip body, and secured to the object to be clipped.

Because the clip securing member is separately formed from the object to which a clip is secured, the object to which a clip is secured may be selected so as to be secured to the object to be clipped.

The clip securing member can have discontinuous rotation stop positions for the clip body.

The term "discontinuous rotation stop position" means that positions where the clip body can be stopped are predetermined, and the clip body cannot be stopped at positions other than the predetermined positions. For example, a position that is frequently used is predetermined as a stop position to increase convenience.

Because the clip securing member provides discontinuous rotation stop positions for the clip body, a user may select a rotation stop position.

When the object to which a clip is secured is a writing instrument having a writing tip, and a position where the side of the opening of the clip body faces a side of the writing tip is a standard position, the clip body can stop at either or both at least 90° position and −90° position apart from the standard position.

For angles to the standard position, positive values represent clockwise angles, and negative values represent counterclockwise angles.

The rotation may be limited within a particular range such as from 90° to −90° to the standard position.

The standard position can be first set as a rotation stop position that is the most frequently used, which is convenient. Further, for rotational use, the clip body can be rotated through 90° and/or −90° to the standard position as convenient rotation stop positions.

For example, when the object to which a clip is secured is a writing instrument and the object to be clipped is a notebook, the clip body is rotated through 90° from the standard position with respect to the clip securing member and then clipped to the notebook so that a size of a protrusion of the writing instrument from the notebook can be reduced.

For example, when the object to which a clip is secured is a writing instrument and the object to be clipped is a collar of clothing, setting the angle to 45°, −45°, 135°, or −135° to the standard position facilitates securing and provides a quiet appearance.

One of the clip body and the clip securing member has a protrusion, and the other has a recess that fits the protrusion to allow rotation and stop of the clip body.

The numbers of the protrusions and the recesses are not limited. A plurality of protrusions and a plurality of recesses may be provided, or one protrusion and one recess may be provided. The numbers of the protrusions and the recesses do not have to be the same, and for example, one protrusion and a plurality of recesses may be provided.

The protrusions and the recesses may be respectively spaced equiangularly, and may be provided at four, six, eight, or twelve equiangular positions.

Such a configuration allows the protrusion and the recess to fit each other when the rotation stops to achieve sufficient stop of rotation.

Preferably, the clip body has a flange and an insertion shaft connecting the flange and the clip body and having a smaller diameter than the flange, the clip securing member has an insertion hole into which the flange and the insertion shaft are inserted, and a leaf spring is inserted between the flange passed through the insertion hole and the clip securing member.

According to a clip structure assembling method for forming a clip structure of the invention, a clip body has a flange and an insertion shaft connecting the flange and the clip body and having a smaller diameter than the flange, a clip securing member has an insertion hole into which the flange and the insertion shaft are inserted, and after the flange and the insertion shaft of the clip body are inserted into the insertion hole of the clip securing member, a leaf spring is inserted between the flange passed through the insertion hole and the clip securing member.

When a coil spring is used, a spring bracket or the like generally requires to be assembled after the coil spring is provided, which takes much time in assembly. According to the invention, the leaf spring may be simply inserted for assembly, thus facilitating assembly.

DETAILED DESCRIPTION OF THE PREFERRED EMBODIMENTS

Now, embodiments of the invention will be described in detail with reference to FIGS. 1 to 8.

Figure 1:
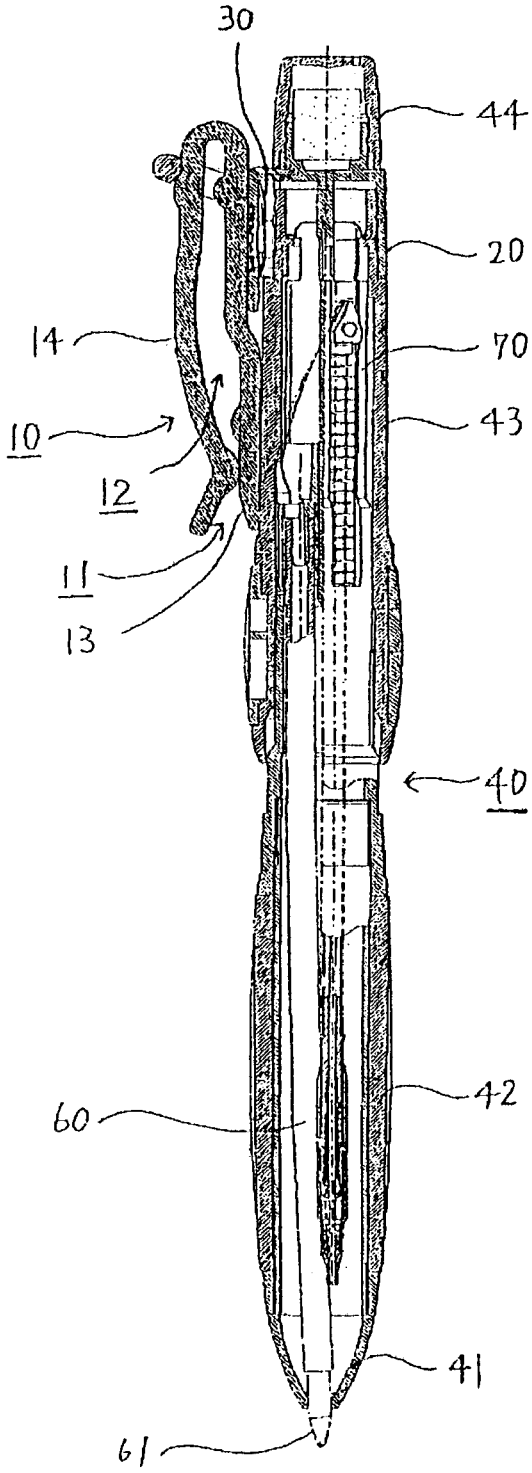
FIG. 1 is a vertical sectional view of a first embodiment.

FIG. 1 is a vertical sectional view of a first embodiment of the invention. An object to which a clip is secured 40 in this embodiment is a rotation propelling type of writing instrument in which a front barrel 42 and a rear barrel 43 are relatively rotated to advance a writing tip 61 of a refill 60. The writing instrument 40 includes a tip opening 41, the front barrel 42, the rear barrel 43, and a top cap 44.

A ring-shaped clip securing member 20, which has an inner diameter of the size equal to the size of an outer diameter of the rear barrel 43, is secured to the rear barrel 43, and a clip body 10 is secured via the clip securing member 20.

Hereinafter, the front refers to the side of the writing tip 61, and the rear refers to the side opposite the writing tip 61.

The clip body 10 is a member that is formed into a substantial U shape to form a holding portion 12 in which a thin object 50 to be clipped, for example, a breast pocket cloth is held. Specifically, a secured piece 13 along the rear barrel 43 and a moving piece 14 that opens/closes an opening 11 for holding the object to be clipped 50 form the substantial U shape. The side of the opening 11 of the clip body 10 faces the side of the writing tip 61. As shown in FIG. 3, an insertion shaft 17 and a flange 16 also form part of the clip body 10.

Now, also with reference to FIGS. 2 to 4, a detailed configuration for rotating and stopping the clip body 10 will be described.

Figure 2B:
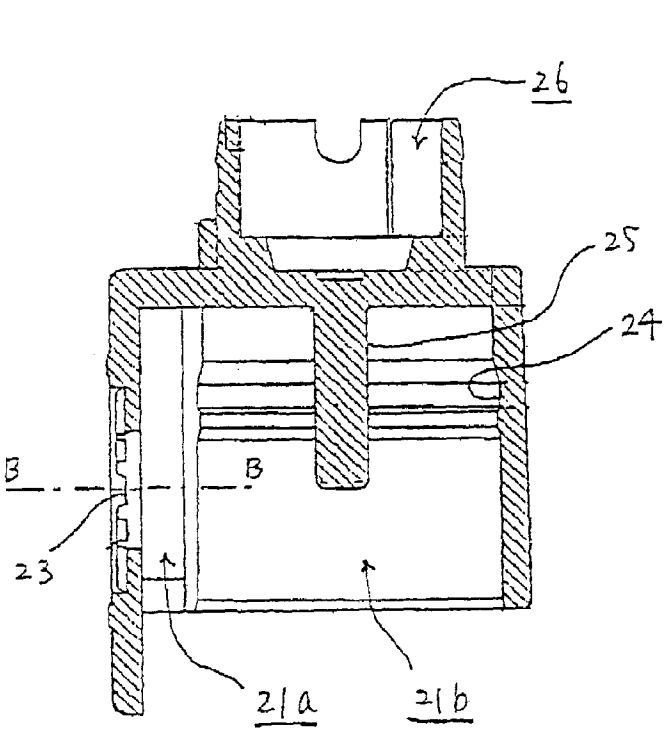
FIG. 2B is a sectional view taken along the line 2B—2B in FIG. 2A.
Figure 2A:
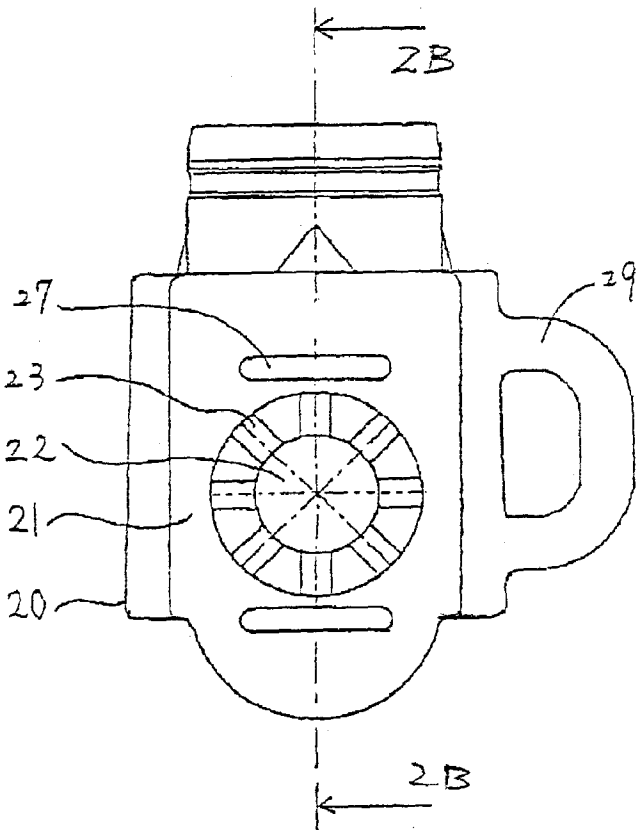
FIG. 2A is a front view of a clip securing member according to the first embodiment.

FIG. 2A is a front view of the clip securing member 20, and FIG. 2B is a sectional view taken along the line 2B—2B in FIG. 2A.

A clip support box 21 is formed on one side of the clip securing member 20. A leaf spring receiving space 21*a* is formed in the clip support box 21, and an insertion hole 22, recesses 23 and stoppers 27 are formed on an outer surface of the clip support box 21.

Specifically, the recesses 23 are provided around the insertion hole 22, and spaced equiangularly at 45°. A protrusion is formed on either neighboring side of each recess 23, and when the clip body 10 is rotated, a protrusion 18 provided on the clip body 10 is detached from the recess 23 and placed on the protrusion on either neighboring side of the recess 23. At this time, forward and backward movement of the clip body 10 is restricted by the stoppers 27 provided on the front and the back of the recesses 23. A stopper 27 may be provided on either the front or the back.

Further, a ring for a string 29 is formed on another side of the clip securing member 20, through which a string is passed to be used as a hanging type of writing instrument. A housing portion 26 is formed on the rear of the clip securing member 20, into which an eraser is inserted. A rear barrel receiving space 21*b* is formed inside the clip securing member 20, in which a fitting portion 24 to be fitted on the rear barrel 43 and a guide pin 25 are formed. The fitting portion 24 is fitted on the rear barrel 43 so that it is secured to the rear barrel 43. The guide pin 25 is fitted into a hole formed in a propelling mechanism 70 provided in the rear barrel 43.

Figure 3A:
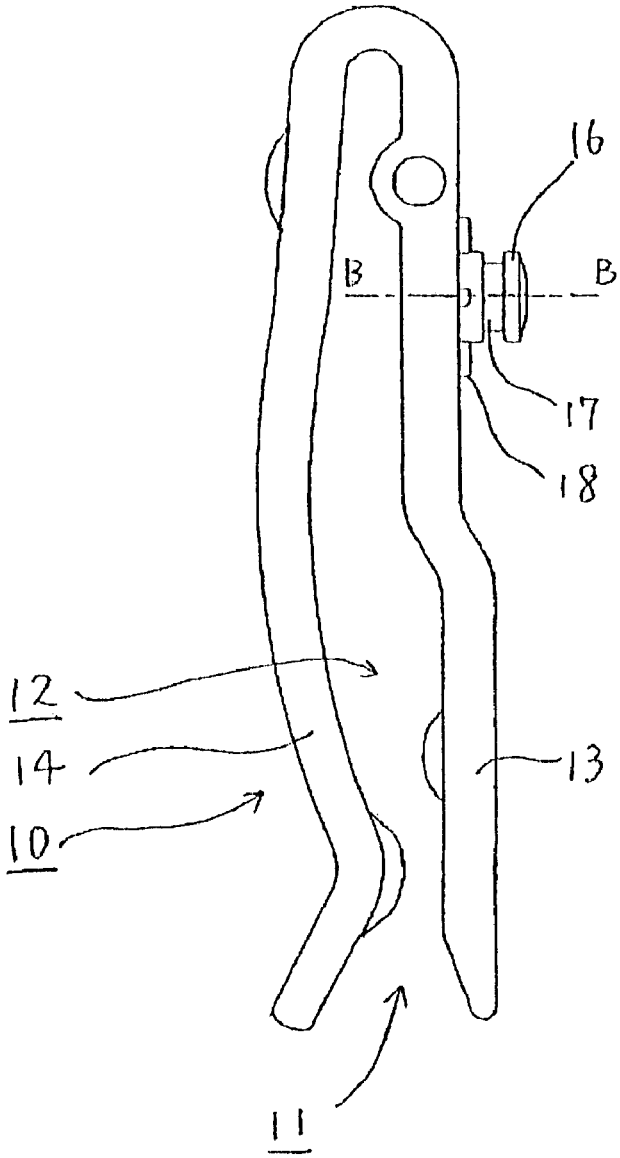
FIG. 3A is a side view of a clip body according to the first embodiment.
Figure 3B:
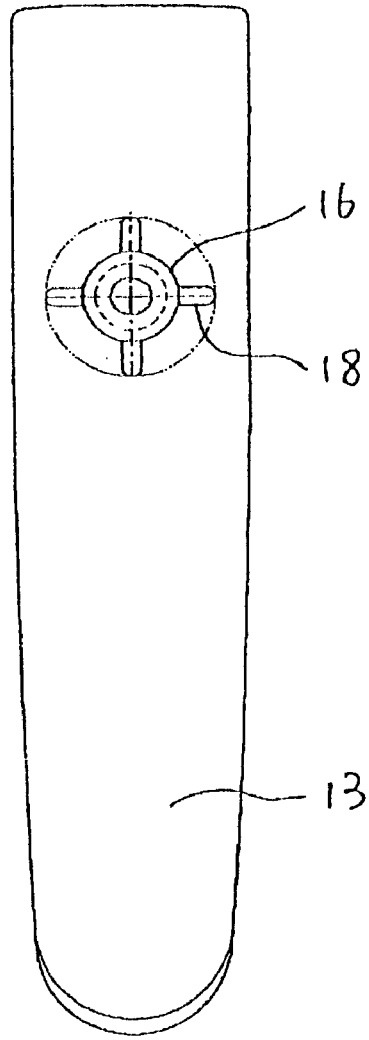
FIG. 3B is a front view of the clip body.

FIG. 3A is a side view of the clip body, and FIG. 3B is a front view of the clip body.

The clip body 10 is a member that is formed into the substantial U shape to form the holding portion 12 in which the thin object to be clipped 50, for example, the breast pocket cloth is held. Specifically, the secured piece 13 along the rear barrel 43 and the moving piece 14 that opens/closes the opening 11 for holding the object 50 to be clipped form the substantial U shape.

The insertion shaft 17 protrudes perpendicularly to the secured piece 13 on the outer surface in the rear of the secured piece 13. The flange 16 is formed on an end of the insertion shaft 17, and the flange 16 has a larger diameter than the insertion shaft 17. Further, the protrusions 18 that fit into the recesses 23 provided in the clip securing member 20 are formed around a base of the insertion shaft 17 on the outer surface of the secured piece 13. The protrusions 18 are spaced equiangularly at 90°.

Figure 4A:
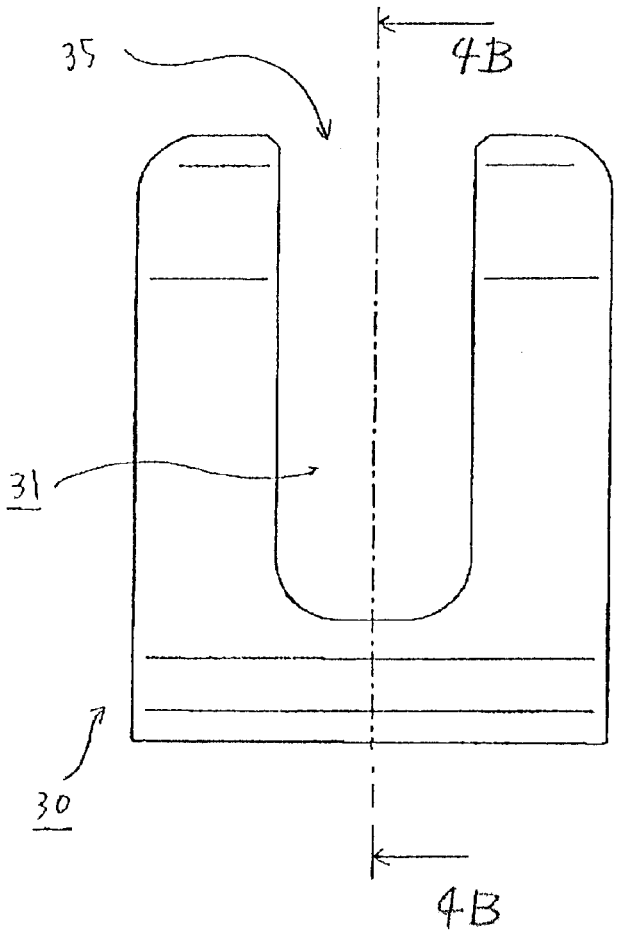
FIG. 4A is a front view of a leaf spring as an elastic body according to the first embodiment.
Figure 4B:
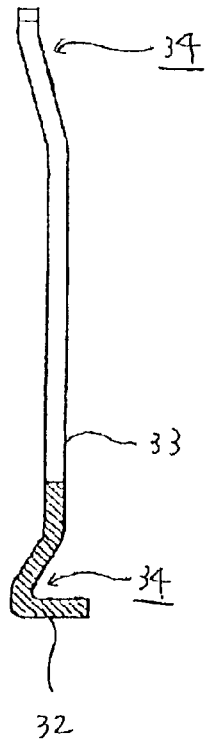
FIG. 4B is a sectional view taken along the line 4B—4B in FIG. 4A.

FIG. 4A is a front view of a leaf spring as an elastic body, and FIG. 4B is a sectional view taken along the line 4B—4B in FIG. 4A.

The leaf spring 30 has, in the center, a leaf spring slit 31 having an opening portion 35 on one end. A recessed surface 34 and a protruded surface 33 are formed along the slit. The recessed surface 34 is formed on either side of the protruded surface 33. Further, a detachment stop 32 is formed in a position opposite the opening portion 35, and placing other members near the detachment stop 32 allows the detachment stop 32 to abut against other members to prevent detachment of the leaf spring 30. In the embodiment, the rear barrel 43 abuts against the detachment stop 32 as shown in FIG. 1.

An assembling method will be described hereinafter. As described above, the clip body 10 includes the flange 16 and the insertion shaft 17 connecting the flange 16 and the clip body 10 and having the smaller diameter than the flange 16, and the clip securing member 20 has the insertion hole 22 into which the flange 16 and the insertion shaft 17 are inserted.

First, the flange 16 and the insertion shaft 17 of the clip body 10 are inserted into the insertion hole 22 of the clip securing member 20. Then, the leaf spring 30 is inserted between the flange 16 and the clip securing member 20 with the protruded surface 33 of the leaf spring 30 facing the flange 16. At this time, the insertion shaft 17 is inserted into the leaf spring slit 31 from the opening portion 35 of the leaf spring slit 31 in the leaf spring 30. A writing instrument having a clip structure as shown in FIG. 1 is formed by assembling as described above. The rear barrel 43 abuts against the detachment stop 32 of the leaf spring 30 to prevent detachment of the leaf spring 30.

The clip body 10 is rotated around a rotation axis (the line B—B) shown in FIGS. 2 and 3. In this embodiment, the center of the insertion shaft 17 of the clip body 10 is the rotation axis. The clip body 10 is urged toward the clip securing member 20 along the rotation axis (the line B—B) by the leaf spring 30. The clip body 10 is urged to abut against the clip securing member 20. As described above, the recess 23 and the protrusion 18 are formed on the abutting position.

A rotation force is applied to the clip body 10 to allow the protrusion 18 formed on the clip body 10 to be detached form the recess 23 formed in the clip securing member 20 and to freely rotate. After rotating by a fixed angle, the protrusion 18 fits into a different recess 23 to stop rotation of the clip.

Figure 5A:
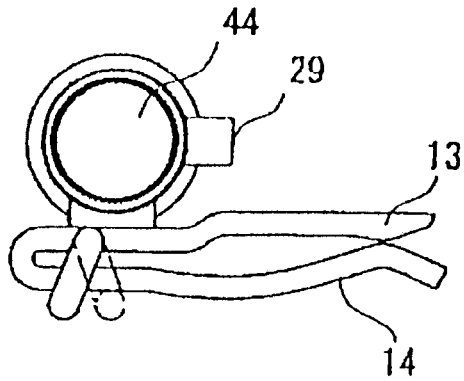
FIGS. 5A and B show a state where the clip body is rotated through −90° from a standard position.
Figure 5B:
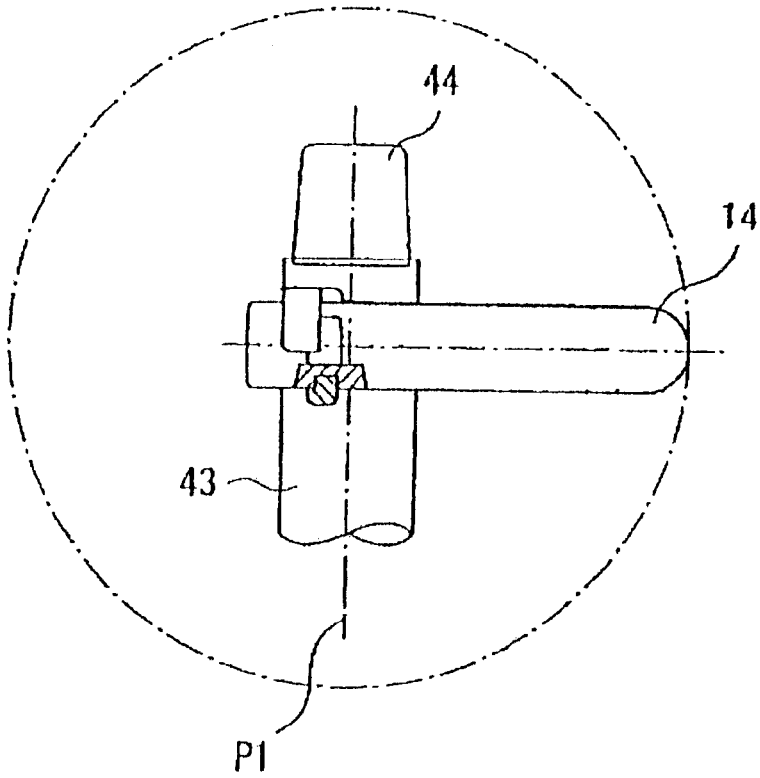

FIG. 5 shows a state where the clip body 10 is rotated −90° from a standard position P1, and FIG. 5A is a top view and FIG. 5B is a front view of the clip structure.

When the clip body 10 is rotated −90° from the standard position P1, and the object 50 to be clipped is a cover sheet of a notebook having a vertical opening axis, a size of a protrusion of the writing instrument 40 from the notebook can be reduced as compared with a general writing instrument with a clip.

Figure 6:
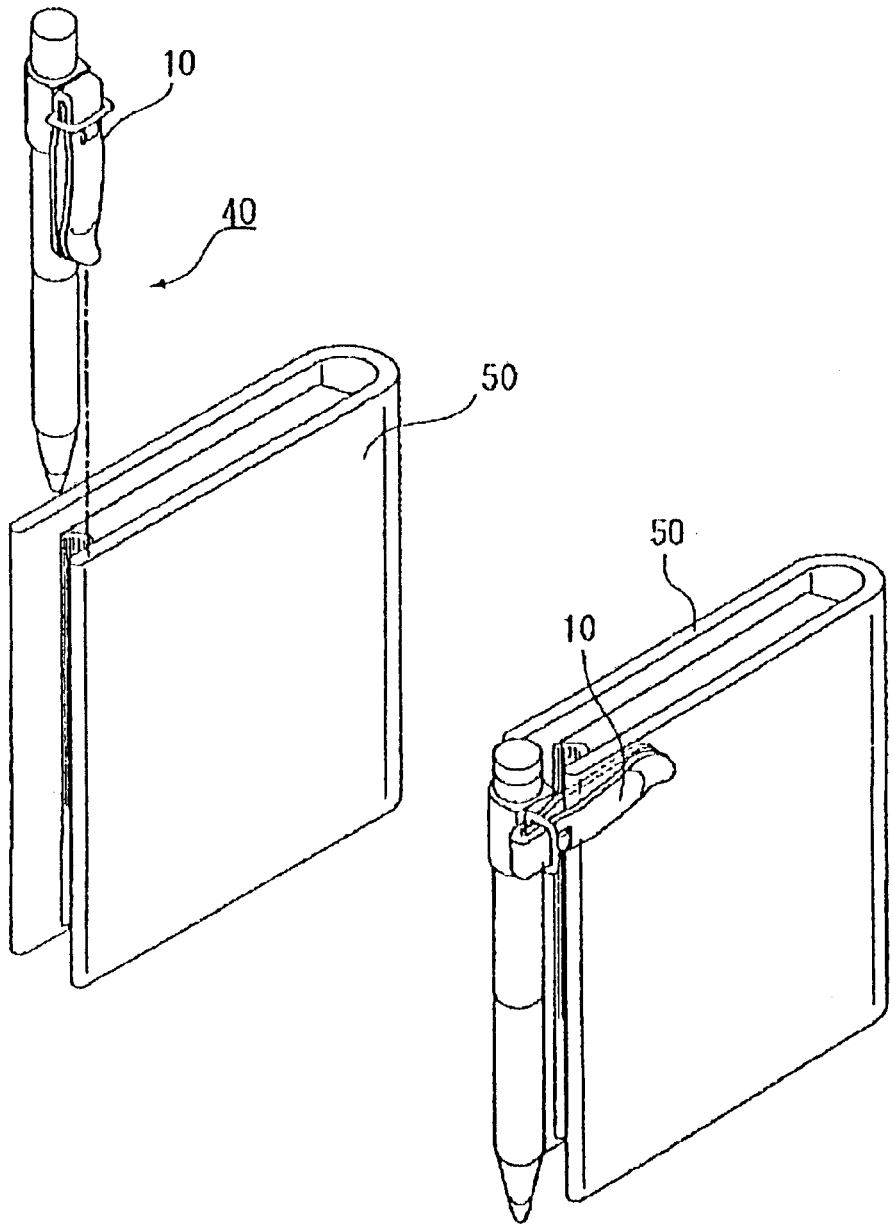
FIG. 6 is a perspective view when an object to be clipped is a notebook.

FIG. 6 is a perspective view when the object 50 to be clipped is a notebook, and the object 40 to which a clip is secured is a writing instrument. A relatively thick cover sheet of the notebook can be clipped, the clip body 10 can be rotated 90° and fixed without interfering with the notebook, and the writing instrument 40 and the notebook 50 are integrally carried.

Figure 7:
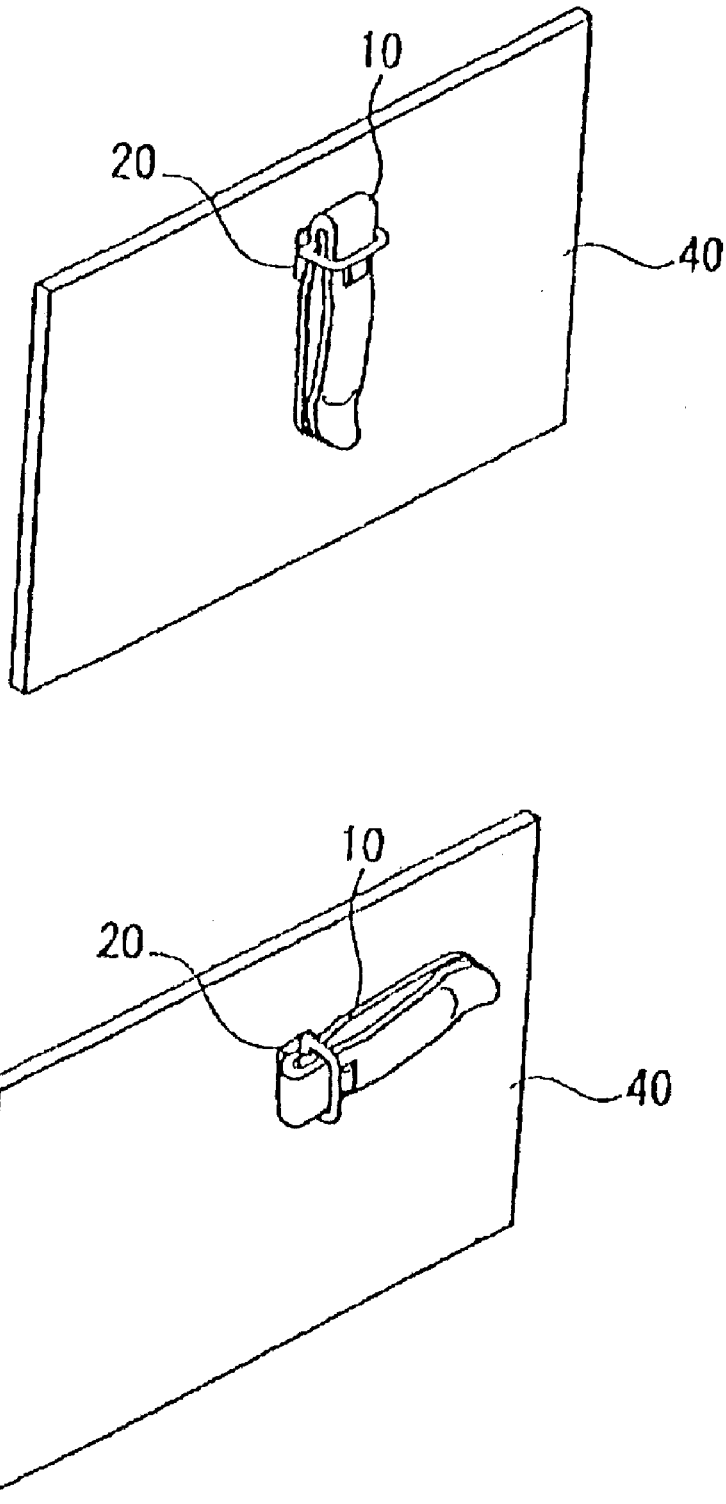
FIG. 7 is a perspective view of an assembly when an object to which a clip is secured is a name tag.

FIG. 7 is a perspective view when the object 40 to which a clip is secured is a name tag. A conventional name tag is only intended to be attached to a breast pocket of a jacket or the like, and those who often wear clothes without breast pocket (particularly, women) have to attach a name tag on a slant to a collar. However, according to the embodiment, the clip body 10 can be rotated with respect to the name tag 40, thus eliminating the above described inconvenience.

Figure 8:
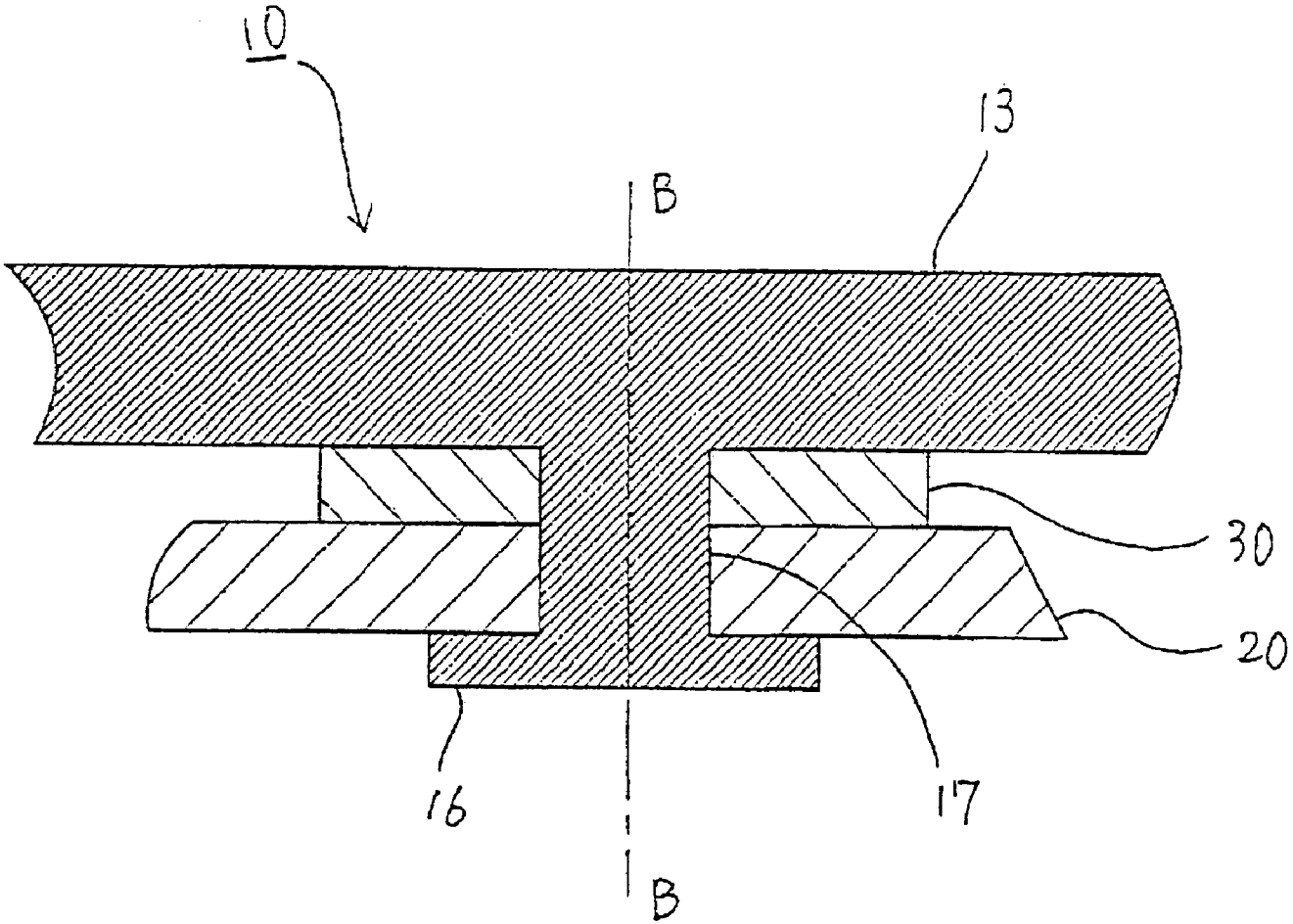
FIG. 8 is a schematic sectional view of a second embodiment.

FIG. 8 is a schematic view of a second embodiment. In this embodiment, a leaf spring 30 as an elastic body is placed in a position different from the position in the first embodiment.

In this embodiment, the leaf spring 30 is not provided between a flange 16 and a clip securing member 20, but is provided between a secured piece 13 of a clip body 10 and the clip securing member 20. The flange 16 as a part of the clip body 10 is abutted against the clip securing member 20 by the leaf spring 30, and thus a side of an opening 11 of the clip body 10 can rotate along an arc and stop. Either the flange 16 or the clip securing member 20 may have a protrusion, and the other may have a recess, on an abutting position between the flange 16 and the clip securing member 20.

While the principles of the invention have been described above in connection with specific embodiments, and particular modifications thereof, it is to be clearly understood that this description is made only by way of example and not as a limitation on the scope of invention.

What is claimed is:

1. A clip structure comprising:

a clip body including a substantially U shape to form a holding portion in which a thin object to be clipped is held and an opening on one side;

the clip structure securing member that is integral with an object to which a clip is secured, and secures said clip body such that a side of the opening of the clip body is capable of rotating along an arc track and stopping rotating; and an elastic body that urges the clip body along a rotation axis of the clip body toward the clip securing member is provided to urge the clip body toward the clip securing member, wherein the object to which the clip structure is secured includes a writing instrument including a writing tip, and a position where the side of the opening of the clip body faces a side of the writing tip includes a standard position, the clip body is capable of stopping at at least a 90° position and a −90° position apart from the standard position.

2. The clip structure according to claim 1, wherein the clip securing member is integrally formed with the object to which the clip structure is secured.

3. The clip structure according to claim 1, wherein the clip securing member is separately formed from the object to which the clip structure is secured.

4. The clip structure according to claim 1, wherein the clip securing member provides discontinuous rotation stop positions for the clip body.

5. The clip structure according to claim 1, wherein one of the clip body and the clip securing member includes a protrusion, and the other of the clip body and the clip securing member includes a recess that fits said protrusion to allow rotation and stopping of the clip body.

6. A clip structure assembling method for forming a clip structure, said clip structure comprising:

a clip body including a substantially U shape to form a holding portion in which a thin object to be clipped is held and an opening on one side;

the clip structure securing member that is integral with an object to which a clip is secured, and secures said clip body such that a side of the opening of the clip body is capable of rotating along an arc track and stopping rotating; and an elastic body that urges the clip body along a rotation axis of the clip body toward the clip securing member is provided to urge the clip body toward the clip securing member, said elastic body including a leaf spring, wherein the clip body includes a flange and an insertion shaft connecting the flange and the clip body and includes a smaller diameter than the flange, the clip securing member includes an insertion hole into which said flange and the insertion shaft are inserted, and after the flange and the insertion shaft of the clip body are inserted into the insertion hole of the clip securing member, the leaf spring is inserted between said flange passed through the insertion hole and the clip securing member.

7. A clip structure comprising:

a clip body including a substantially U shape to form a holding portion in which a thin object to be clipped is held and an opening on one side;

the clip structure securing member that is integral with an object to which a clip is secured, and secures said clip body such that a side of the opening of the clip body is capable of rotating along an arc track and stopping rotating; and an elastic body that urges the clip body along a rotation axis of the clip body toward the clip securing member is provided to urge the clip body toward the clip securing member, said elastic body including a leaf spring, wherein the clip body includes a flange and an insertion shaft connecting the flange and the clip body and includes a smaller diameter than the flange, the clip securing member includes an insertion hole into which said flange and the insertion shaft are inserted, and the leaf spring is inserted between said flange passed through the insertion hole and the clip securing member.

8. The clip structure according to claim 7, wherein one of the clip body and the clip securing member includes a protrusion, and the other of the clip body and the clip securing member includes a recess that fits said protrusion to allow rotation and stopping of the clip body.

9. The clip structure according to claim 7, wherein the clip securing member is integrally formed with the object to which the clip structure is secured.

10. The clip structure according to claim 7, wherein the clip securing member is separately formed from the object to which the clip structure is secured.

11. The clip structure according to claim 7, wherein the clip securing member provides discontinuous rotation stop positions for the clip body.

* * * * *